US010871730B2

(12) United States Patent
Kita et al.

(10) Patent No.: US 10,871,730 B2
(45) Date of Patent: Dec. 22, 2020

(54) DEVELOPER CONTAINER, DEVELOPER SUPPLY DEVICE, PROCESS CARTRIDGE, AND IMAGE FORMING APPARATUS INCLUDING A COMMUNICATION PORT IN A PARTITION

(71) Applicants: Emi Kita, Kanagawa (JP); Hiroaki Nieda, Kanagawa (JP)

(72) Inventors: Emi Kita, Kanagawa (JP); Hiroaki Nieda, Kanagawa (JP)

(73) Assignee: RICOH COMPANY, LTD., Tokyo (JP)

( * ) Notice: Subject to any disclaimer, the term of this patent is extended or adjusted under 35 U.S.C. 154(b) by 0 days.

(21) Appl. No.: 16/689,115

(22) Filed: Nov. 20, 2019

(65) Prior Publication Data

US 2020/0166872 A1 May 28, 2020

(30) Foreign Application Priority Data

Nov. 26, 2018 (JP) ..... 2018-220553

(51) Int. Cl.
*G03G 15/08* (2006.01)

(52) U.S. Cl.
CPC ..... *G03G 15/0877* (2013.01); *G03G 15/0868* (2013.01); *G03G 15/0875* (2013.01);
(Continued)

(58) Field of Classification Search
CPC ..... G03G 15/0868; G03G 15/0877; G03G 2215/0685; G03G 2215/083;
(Continued)

(56) References Cited

U.S. PATENT DOCUMENTS

2013/0028638 A1 1/2013 Tsuritani et al.
2013/0149011 A1* 6/2013 Hayashida ..... G03G 15/0877 399/263

(Continued)

FOREIGN PATENT DOCUMENTS

JP 2009042790 A * 2/2009
JP 2010-020227 1/2010

(Continued)

OTHER PUBLICATIONS

U.S. Appl. No. 16/316,523, filed Jul. 13, 2017, Kuniyori Takano, et al.

*Primary Examiner* — Robert B Beatty
(74) *Attorney, Agent, or Firm* — Xsensus LLP

(57) ABSTRACT

A developer container includes a developer chamber configured to store a developer, a discharge port configured to discharge the developer in the developer chamber to a developing device, a developer conveyance path configured to transport the developer in the developer chamber to the discharge port, a supply port configured to supply the developer in the developer chamber to the developer conveyance path, a conveyor disposed in the developer conveyance path and configured to transport the developer to the discharge port, a partition between the developer conveyance path and the developer chamber, and a communication port disposed in the partition between the discharge port and the supply port and connecting the developer conveyance path with the developer chamber.

8 Claims, 8 Drawing Sheets

(52) U.S. Cl.
CPC ..... *G03G 2215/068* (2013.01); *G03G 2215/0685* (2013.01)

(58) Field of Classification Search
CPC ..... G03G 2215/0833; G03G 15/0875; G03G 2215/068
USPC ..... 399/260, 263
See application file for complete search history.

(56) References Cited

U.S. PATENT DOCUMENTS

| | | | | |
|---|---|---|---|---|
| 2013/0259532 | A1* | 10/2013 | Kubota | G03G 15/0891 399/254 |
| 2014/0050502 | A1* | 2/2014 | Tsuritani | G03G 15/80 399/90 |
| 2017/0168446 | A1 | 6/2017 | Nieda | |
| 2017/0199490 | A1 | 7/2017 | Nieda | |
| 2018/0112762 | A1 | 4/2018 | Nieda | |
| 2018/0267430 | A1 | 9/2018 | Kita et al. | |
| 2018/0356748 | A1 | 12/2018 | Matsumoto et al. | |
| 2019/0064699 | A1 | 2/2019 | Nodera et al. | |
| 2019/0179237 | A1 | 6/2019 | Kita et al. | |
| 2019/0243284 | A1 | 8/2019 | Nieda | |
| 2019/0243285 | A1 | 8/2019 | Nieda | |
| 2019/0243303 | A1 | 8/2019 | Nieda | |
| 2019/0286011 | A1 | 9/2019 | Nieda et al. | |

FOREIGN PATENT DOCUMENTS

| | | |
|---|---|---|
| JP | 2013-029570 | 2/2013 |
| JP | 2014-119704 | 6/2014 |

* cited by examiner

DEVELOPER CONTAINER, DEVELOPER SUPPLY DEVICE, PROCESS CARTRIDGE, AND IMAGE FORMING APPARATUS INCLUDING A COMMUNICATION PORT IN A PARTITION

CROSS-REFERENCE TO RELATED APPLICATION

This patent application is based on and claims priority pursuant to 35 U.S.C. § 119(a) to Japanese Patent Application No. 2018-220553, filed on Nov. 26, 2018, in the Japan Patent Office, the entire disclosure of which is hereby incorporated by reference herein.

BACKGROUND

Technical Field

Embodiments of the present disclosure generally relate to a developer container, a developer supply device, a process cartridge, and an image forming apparatus.

Description of the Related Art

There is a known developer container that includes a developer chamber to store a developer, a discharge port to discharge the developer in the developer chamber to a developing device, a developer conveyance path to transport the developer in the developer chamber to the discharge port, a supply port to supply the developer in the developer chamber to the developer conveyance path, a conveyor disposed in the developer conveyance path to transport the developer to the discharge port, a partition between the developer conveyance path and the developer chamber, and a communication port disposed in the partition to communicate between the developer conveyance path and the developer chamber.

SUMMARY

Embodiments of the present disclosure describe an improved developer container that includes a developer chamber configured to store a developer, a discharge port configured to discharge the developer in the developer chamber to a developing device, a developer conveyance path configured to transport the developer in the developer chamber to the discharge port, a supply port configured to supply the developer in the developer chamber to the developer conveyance path, a conveyor disposed in the developer conveyance path and configured to transport the developer to the discharge port, a partition between the developer conveyance path and the developer chamber, and a communication port disposed in the partition between the discharge port and the supply port and connecting the developer conveyance path with the developer chamber.

BRIEF DESCRIPTION OF THE SEVERAL VIEWS OF THE DRAWINGS

A more complete appreciation of the disclosure and many of the attendant advantages thereof will be readily obtained as the same becomes better understood by reference to the following detailed description when considered in connection with the accompanying drawings, wherein.

Figure 1:
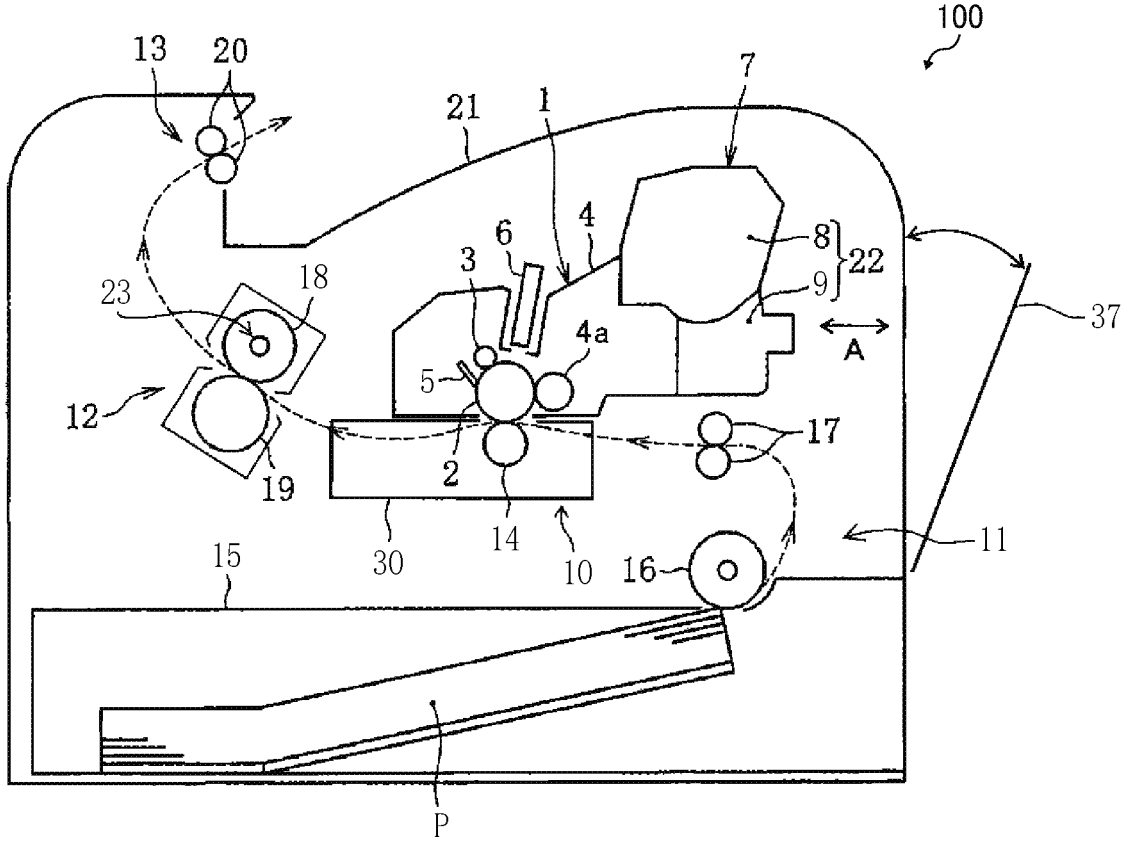
FIG. 1 is a schematic view of a printer as an example of an image forming apparatus according to an embodiment of the present disclosure.

The accompanying drawings are intended to depict embodiments of the present disclosure and should not be interpreted to limit the scope thereof. The accompanying drawings are not to be considered as drawn to scale unless explicitly noted. In addition, identical or similar reference numerals designate identical or similar components throughout the several views.

DETAILED DESCRIPTION

In describing embodiments illustrated in the drawings, specific terminology is employed for the sake of clarity. However, the disclosure of this patent specification is not intended to be limited to the specific terminology so selected, and it is to be understood that each specific element includes all technical equivalents that have the same function, operate in a similar manner, and achieve a similar result.

As used herein, the singular forms "a", "an", and "the" are intended to include the plural forms as well, unless the context clearly indicates otherwise.

An electrophotographic printer 100 to form an image by an electrophotographic method is described below as an example of an image forming apparatus according to an embodiment of the present disclosure.

FIG. 1 is a schematic view of the printer 100 according to the present embodiment.

The printer 100 illustrated in FIG. 1 is a monochrome printer. A process cartridge 1 serving as a removable unit is removably installed in the printer 100. The process cartridge 1 includes a photoconductor 2 as an image bearer to bear images on a surface thereof, a charging roller 3 as a charging device to charge the surface of the photoconductor 2, a developing device 4 to develop a latent image on the photoconductor 2 into a visible image, and a cleaning blade 5 as a cleaning device to clean the surface of the photoconductor 2. A light-emitting diode (LED) head array 6 is disposed around the photoconductor 2. The LED head array 6 serves as an exposure device that exposes the surface of the photoconductor 2.

Additionally, a toner cartridge 7 serving as a developer container is detachably attached to the process cartridge 1. Inside a container body 22 of the toner cartridge 7, a developer chamber 8 is disposed to store toner as a developer to be supplied to the developing device 4. The toner cartridge 7 according to the present embodiment further includes, as a portion of the toner cartridge 7, a developer collection chamber 9 to collect excess toner removed by the cleaning blade 5.

The printer 100 further includes a sheet feeder 11, a transfer unit 10 to transfer images onto sheets P as transfer media fed by the sheet feeder 11, a fixing device 12 to fix images on the sheets P, and an output device 13 to eject the sheets P outside the printer 100.

The transfer unit 10 includes a transfer roller 14 as a transferor rotatably supported by a transfer frame 30. The transfer roller 14 contacts the photoconductor 2 in a state in which the process cartridge 1 is installed in the printer 100, thereby forming a transfer nip between the transfer roller 14 and the photoconductor 2. Additionally, the transfer roller 14 is electrically connected to a power source and receives a predetermined amount of voltage that is either direct current (DC) voltage, alternating current (AC) voltage, or including both.

The sheet feeder 11 includes a sheet tray 15 to contain sheets P and a sheet feeding roller 16 to feed the sheets P contained in the sheet tray 15. Downstream from the sheet feeding roller 16 in a direction in which the sheet P is transported, a registration roller pair 17 is provided as a timing roller pair to transport the sheet P timely to the transfer nip. It is to be noted that "sheet P" used here includes, in addition to plain paper, thick paper, post cards, envelopes, thin paper, coated paper, art paper, tracing paper, and the like. Additionally, overhead projector (OHP) transparency (OHP sheet or OHP film) may be used as a recording medium.

The fixing device 12 includes a fixing roller 18 serving as a fixing member and a pressure roller 19 serving as a pressure member. The fixing roller 18 is heated by an infrared heater 23 disposed inside the fixing roller 18. The pressure roller 19 is pressed against and contacts the fixing roller 18, and the area or portion of contact between the pressure roller 19 and the fixing roller 18 serves as a fixing nip.

The output device 13 includes an output roller pair 20. An upper face of the printer 100 is partly recessed into an output tray 21, and the sheet P ejected by the output roller pair 20 is stacked on the output tray 21.

With reference to FIG. 1, basic operations of the printer 100 according to the present embodiment are described below. When image formation starts, the photoconductor 2 of the process cartridge 1 rotates clockwise in FIG. 1, and the charging roller 3 uniformly charges the surface of the photoconductor 2 in a predetermined polarity. Then, the LED head array 6 directs a light beam onto the charged surface of the photoconductor 2 based on image data input from an external device. Thus, an electrostatic latent image is formed on the surface of the photoconductor 2.

The electrostatic latent image formed on the photoconductor 2 is developed into a toner image (visible image) with toner deposited by the developing device 4.

As the image formation starts, the transfer roller 14 rotates, and the predetermined voltage, which is either DC voltage, AC voltage, or including both, is applied to the transfer roller 14, thus forming a transfer electrical field between the transfer roller 14 and the photoconductor 2.

In the bottom portion of the printer 100, the sheet feeding roller 16 starts rotating, and the sheet P is fed out from the sheet tray 15. Then, the registration roller pair 17 temporarily stops the sheet P fed by the sheet feeding roller 16.

The registration roller pair 17 starts rotating at a predetermined timing to transport the sheet P to the transfer nip, timed to coincide with the arrival of the toner image on the photoconductor 2. The toner image on the photoconductor 2 is transferred onto the sheet P as the transfer medium by the effect of the transfer electric field. After the transfer process, the cleaning blade 5 removes excess toner, which is not transferred to the sheet P, remaining on the photoconductor 2, and the removed toner is transported to and collected in the developer collection chamber 9.

Subsequently, the sheet P bearing the toner image is transported to the fixing device 12, and the toner image is fixed on the sheet P by the fixing device 12. Then, the sheet P is ejected outside the printer 100 by the output roller pair 20 and stacked on the output tray 21.

A cover 37 closably openable in the direction indicated by double headed arrow A in FIG. 1 is disposed on the side surface of the printer 100 (on the right side in FIG. 1). The LED head array 6 is coupled to the cover 37 with a link or the like, and the LED head array 6 moves to a retracted position in accordance with the operation of opening the cover 37. In the retracted position, the LED head array 6 does not obstruct the attachment and detachment of the process cartridge 1. Therefore, the process cartridge 1 can be removed from the printer 100 through an opening created by the opening of the cover 37.

Figure 2:
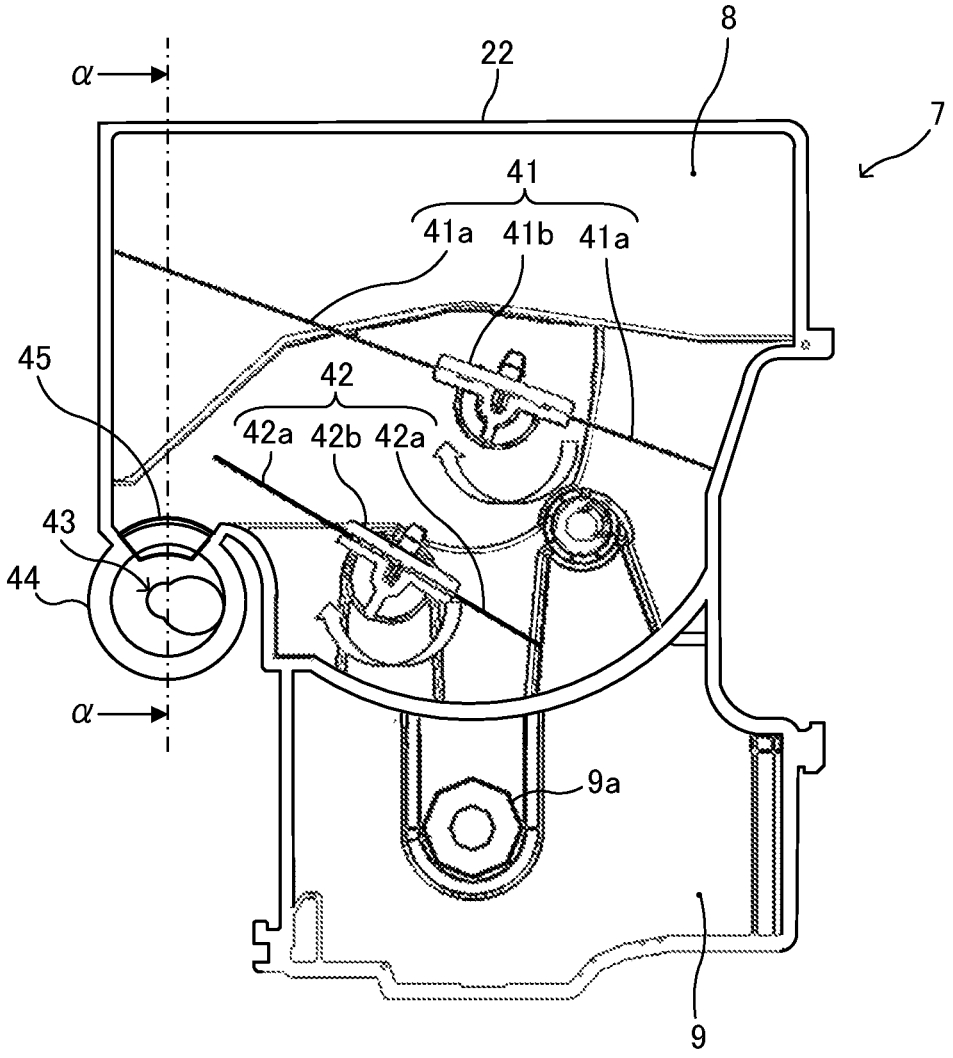
FIG. 2 is a cross-sectional view of a toner cartridge of the image forming apparatus in FIG. 1, along a direction perpendicular to an axial direction.

FIG. 2 is a cross-sectional view of the toner cartridge 7 along a direction perpendicular to an axial direction of agitators (or a conveyor).

As illustrated in FIG. 2, the developer chamber 8 to store toner as the developer to be supplied to the developing device 4 and the developer collection chamber 9 to collect toner (excess toner) removed by the cleaning blade 5 are disposed inside the container body 22 of the toner cartridge 7. Further, a developer conveyance path 44 to transport the toner in the developer chamber 8 to the developing device 4 is disposed in the container body 22.

A first agitator 41 and a second agitator 42 as stirrers to stir the toner in the developer chamber 8 are disposed in the developer chamber 8. The first and second agitators 41 and 42 include agitator shafts 41*b* and 42*b* and blades 41*a* and 42*a* attached to the agitator shafts 41*b* and 42*b*, respectively. In the present embodiment, the blades 41*a* and 42*a* are made of resin sheet. The first and second agitators 41 and 42 are driven to rotate in the direction indicated by the blank arrows in FIG. 2 (in the clockwise direction in FIG. 2) by a driver, thereby stirring the toner in the developer chamber 8.

A conveying screw 43 as the conveyor is disposed in the developer conveyance path 44. A collection screw 9*a* to transport toner removed by the cleaning blade 5 into the developer collection chamber 9 is disposed in the developer collection chamber 9.

Figure 3:
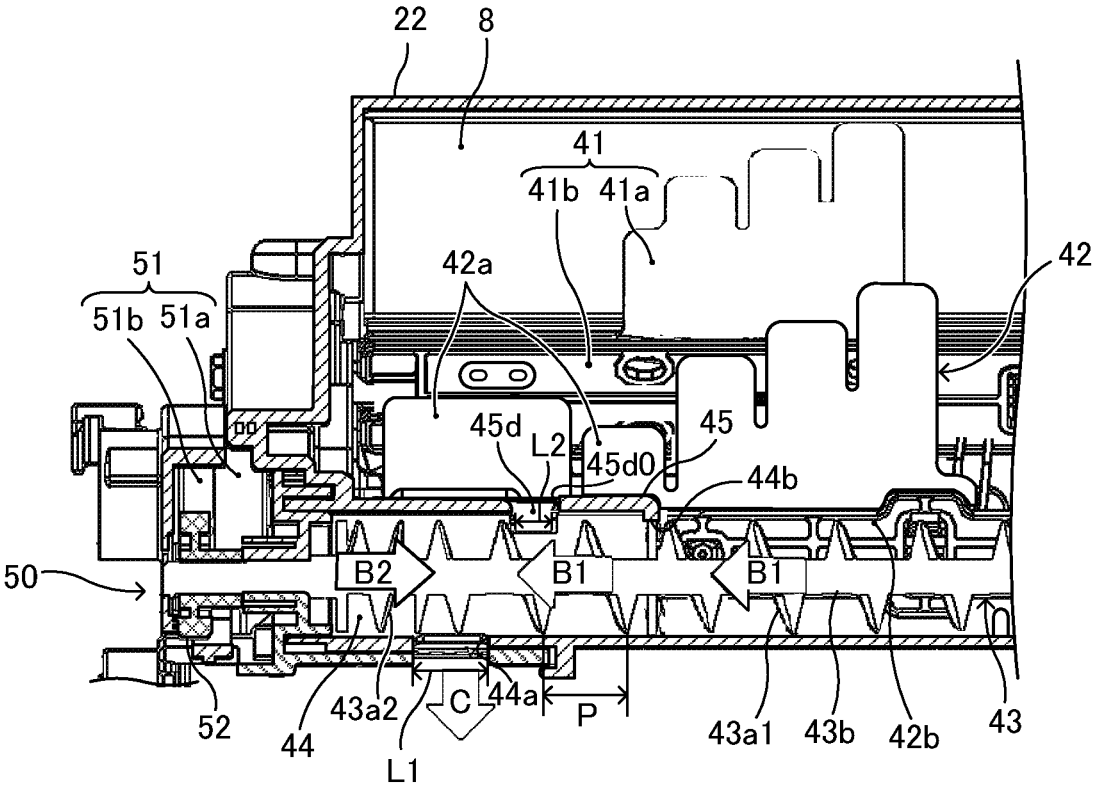
FIG. 3 is a cross-sectional view of the toner cartridge along line a-a in FIG. 2.

FIG. 3 is a cross-sectional view along line a-a in FIG. 2.

As illustrated in FIG. 3, the developer conveyance path 44 is disposed on one end side (the left side in FIG. 3) of the developer chamber 8 in the axial direction of the conveying screw 43. The developer conveyance path 44 is formed by partitioning the developer chamber 8 by a partition 45. A toner supply port 44*b* to which toner in the developer chamber 8 is supplied is disposed on the other end side of the developer conveyance path 44. The toner replenishment port 44*a* as a discharge port to replenish toner in the developer chamber 8 to the developing device 4 is disposed in the developer conveyance path 44.

The conveying screw 43 penetrates the developer conveyance path 44 and includes a shaft 43*b*, a first blade 43*a*1 having a helical shape, and a second blade 43*a*2 having a helical shape. The first blade 43*a*1 transports toner from the toner supply port 44*b* to the toner replenishment port 44*a* in the direction indicated by arrow B1 in FIG. 3. The second blade 43*a*2 is disposed at one end side of the conveying screw 43 (the left side in FIG. 3) relative to the toner replenishment port 44*a* in the axial direction of the conveying screw 43 and transports toner in the developer conveyance path 44 in the direction indicated by arrow B2, that is, the direction opposite to the direction of conveyance of the first blade 43*a*1. The first blade 43*a*1 has a pitch larger than the pitch of the second blade 43*a*2.

Further, a communication port 45*d* connects the developer conveyance path 44 with the developer chamber 8. The communication port 45*d* is disposed in the partition 45 on the upstream side from the toner replenishment port 44*a* in the direction of conveyance of the toner as the developer by the first blade 43*a*1 (hereinafter, referred to as "developer conveyance direction") and on the downstream side from the toner supply port 44*b* in the developer conveyance direction (i.e., between the toner supply port 44*b* and the toner replenishment port 44*a*).

The communication port 45*d* is a hole surrounded by a closed rim 45*d*0. That is, the closed rim 45*d*0 is present in any direction perpendicular to the direction (i.e., vertical direction in FIG. 3) of communication between the developer conveyance path 44 and the developer chamber 8 via the communication port 45*d*. Similarly, the toner replenishment port 44*a* and the toner supply port 44*b* are holes surrounded by closed rims in the direction perpendicular to the direction of communication (i.e., vertical direction for the toner replenishment port 44*a* and horizontal direction for the toner supply port 44*b* in FIG. 3). Note that, in FIG. 3, reference numerals of the toner replenishment port 44*a* and the toner supply port 44*b* point to the closed rims of the holes while a reference numeral of the communication port 45*d* points to the center of the hole.

The length L1 of the toner replenishment port 44*a* in the developer conveyance direction is shorter than the pitch P of the first blade 43*a*1 of the conveying screw 43. Further, the length L2 of the communication port 45*d* in the developer conveyance direction is shorter than the length L1 of the toner replenishment port 44*a* in the developer conveyance direction. That is, in the present embodiment, the pitch P of the first blade 43*a*1>the length L1 of the toner replenishment port 44*a* in the developer conveyance direction>the length L2 of the communication port 45*d* in the developer conveyance direction.

A drive unit 50 is disposed on one end side of the container body 22 (the left side in FIG. 3) and transmits driving force to the first and second agitators 41 and 42 and the conveying screw 43. The drive unit 50 includes a screw gear 52 secured to one end of the conveying screw 43, a step gear 51 including a first gear portion 51*a* and a second gear portion 51*b*, and the like. The screw gear 52 meshes with the second gear portion 51*b* of the step gear 51.

As the driving force is transmitted from the second gear portion 51*b* to the screw gear 52, the conveying screw 43 is driven to rotate, and toner in the developer chamber 8 is transported to the toner supply port 44*b* by the first blade 43*a*1 in the direction indicated by arrow B1 in FIG. 3. The toner supplied from the toner supply port 44*b* to the developer conveyance path 44 by the conveying screw 43 is continuously transported by the first blade 43*a*1 toward the toner replenishment port 44*a* in the direction indicated by arrow B1 in FIG. 3. Then, the toner falls down through the toner replenishment port 44*a* and is supplied to the developing device 4 as indicated by arrow C in FIG. 3.

Further, a portion of the toner that has not fallen from the toner replenishment port 44*a* flows back to the toner replenishment port 44*a* by the second blade 43*a*2 (in the direction indicated by arrow B2 in FIG. 3) and falls down through the toner replenishment port 44*a*. The amount of toner supplied to the developing device 4 is controlled by the driving duration of the conveying screw 43. Thus, the toner cartridge 7 according to the present embodiment functions as a supply device to resupply toner as the developer to the developing device 4.

Some comparative toner cartridges do not include the partition 45 at the upper portion of the developer conveyance path 44. The partition 45 is not provided at the upper portion because, when the toner is supplied to the developing device 4 and the volume of the developer in the developing device 4 increases, air is taken into the developing device 4 along with the rotation of a developing roller 4*a* of the developing device 4, thereby increasing the pressure in the developing device 4 (hereinafter, referred to as "internal pressure"). Since the toner replenishment port 44*a* communicates with the interior of the developing device 4, the internal pressure reaches to the developer conveyance path 44. When the upper portion of the developer conveyance path 44 is blocked and the developer conveyance path 44 has only the toner replenishment port 44*a* and the toner supply port 44*b* as openings, the pressure caused by the conveying screw 43 that transports toner and the internal pressure opposite to the pressure caused by the conveying screw 43 are applied to the toner in the developer conveyance path 44. As a result, high pressure is applied to the toner in the developer conveyance path 44 because of the pressures in opposite directions from both sides.

If high pressure is applied to toner, the toner may agglomerate in the developer conveyance path 44 in a state in which the toner fails to flow easily in the developer conveyance path 44, such as when the toner with physical properties that cause toner particles to agglomerate is used, when the toner is tightened due to vibration caused by transportation, or when the toner stored in a high-temperature and high-humidity environment is used. In a case in which the upper portion of the developer conveyance path 44 is opened without the partition 45 at the upper portion of the developer conveyance path 44, as the toner in the developer conveyance path 44 is subjected to pressures in opposite directions from both sides, a portion of the toner in the developer conveyance path 44 flows back through the open part of the upper portion, thereby reducing the pressure applied to the toner in the developer conveyance path 44. This configuration can prevent the toner from being solidified in the developer conveyance path 44.

However, in such a comparative configuration, when the amount of developer in the developer chamber 8 decreases, the amount of toner supplied to the developing device 4 in any given replenishment becomes one third (⅓) or less of the predetermined amount of toner replenishment.

The amount of toner supplied to the developing device 4 decreases because, when the interior of the developer chamber 8 is sufficiently filled with toner, even if the internal pressure increases to some extent, the toner does not flow back through the open part of the upper portion due to the pressure corresponding to the height of the toner in the developer chamber 8 (hereinafter referred to as "developer pressure"). However, when the amount of toner in the developer chamber 8 decreases and the developer pressure is lowered, a large amount of toner in the developer conveyance path 44 flows back to the developer chamber 8 due to the internal pressure. As a result, the amount of toner that falls down through the toner replenishment port 44*a* decreases and the amount of toner supplied to the developing device 4 decreases.

Figure 4:
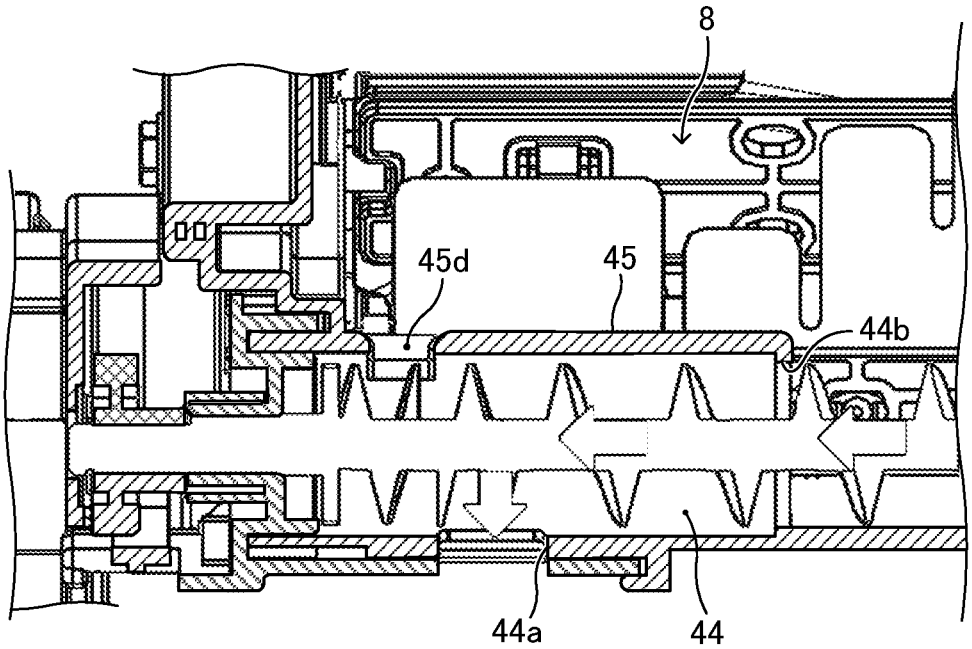
FIG. 4 is a cross-sectional view of a toner cartridge as an example in which a communication port is disposed on the downstream side from a toner replenishment port in a direction of conveyance of developer.

FIG. 4 is a cross-sectional view of a prototype of the toner cartridge 7.

The prototype of the toner cartridge 7 illustrated in FIG. 4 includes a partition 45 disposed at the upper portion of the developer conveyance path 44 and a communication port 45*d* disposed on the downstream side from the toner replenishment port 44*a* of the partition 45 in the developer conveyance direction. Since the partition 45 blocks the upper portion of the developer conveyance path 44, the toner can be prevented from flowing back to the developer chamber 8. If the upper portion of the developer conveyance path 44 is completely blocked by the partition 45, the toner may be solidified in the developer conveyance path 44 as described above. Therefore, a communication port 45*d* is disposed on the downstream side from the toner replenishment port 44*a* in the developer conveyance path 44 so that the toner in the developer conveyance path 44 can flow back unhindered.

An experiment was performed with the prototype illustrated in FIG. 4. However, when the amount of toner in the developer chamber 8 is low, the decrease in the amount of toner replenishment is not sufficiently minimized, and only a 10-20% improvement is obtained as compared with the comparative configuration.

Figure 5:
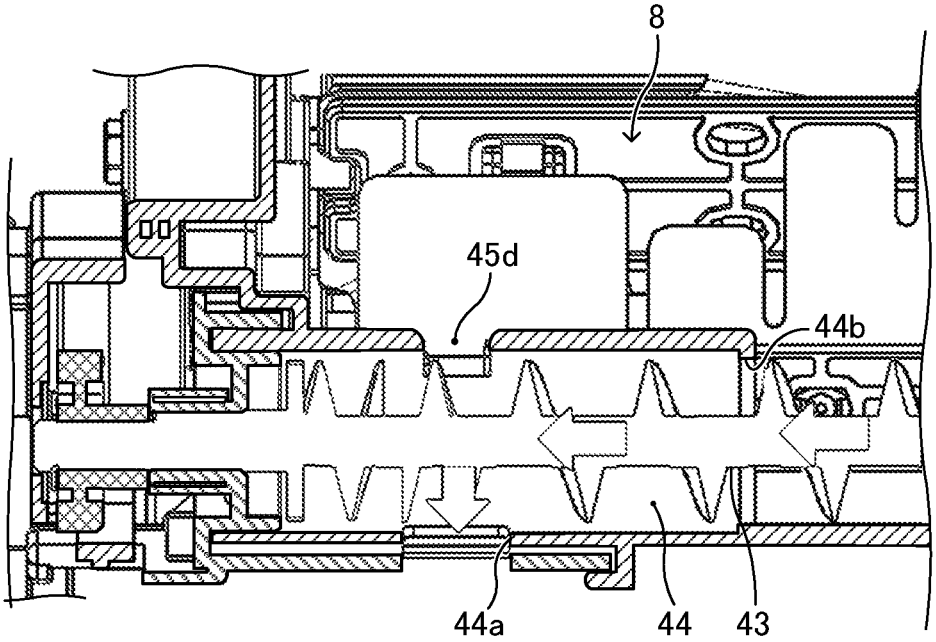
FIG. 5 is a cross-sectional view of a toner cartridge as an example in which a communication port is disposed immediately above the toner replenishment port.

In addition, other experiments were performed with other toner cartridges 7 in which the communication port 45*d* is disposed directly above the toner replenishment port 44*a* as illustrated in FIG. 5 and in which the communication port 45*d* is disposed between the toner supply port 44*b* and the toner replenishment port 44*a* according to the present embodiment as illustrated in FIG. 3. As a result, the communication port 45*d* disposed between the toner supply port 44*b* and the toner replenishment port 44*a* as illustrated in FIG. 3 best minimizes the decrease in the amount of toner replenishment when the amount of toner in the developer chamber 8 decreases, for what is assumed to be the following reason:

When the internal pressure increases, the internal pressure in the direction opposite to the direction of conveyance of toner by the conveying screw 43 is applied to the toner in the developer conveyance path 44. Therefore, the toner in the developer conveyance path is difficult to move toward the toner replenishment port 44*a*.

When the amount of toner in the developer chamber 8 is large, the developer pressure corresponding to the height of the toner is high. Accordingly, the conveying screw 43 can supplies the predetermined amount of toner to the toner supply port 44*b* even if the toner in the developer chamber 8 is difficult to move, causing the toner supplied from the toner supply port 44*b* to push out the toner in the developer conveyance path 44 against the internal pressure. As a result, the amount of toner that moves in the developer conveyance path 44 does not decrease.

However, when the amount of toner in the developer chamber 8 decreases and the developer pressure in front of the toner supply port 44*b* decreases, a portion of the toner transported to the toner supply port 44*b* by the conveying screw 43 does not enter the developer conveyance path 44 through the toner supply port 44*b* and flows back to the developer chamber 8. As a result, the amount of toner supplied through the toner supply port 44*b* decreases, and the effect is reduced that the toner supplied through the toner supply port 44*b* pushes out the toner in the developer conveyance path 44 toward the toner replenishment port 44*a* against the internal pressure. Therefore, the amount of toner that moves to the toner replenishment port 44*a* in the developer conveyance path 44 decreases. As a result, it is assumed that the amount of toner that falls down through the toner replenishment port 44*a* decreases within one replenishment duration, and the amount of toner replenishment decreases.

With the communication port 45*d*, when the internal pressure increases, toner flows back through the communication port 45*d* to the developer chamber 8, and a gap is formed in the toner between the communication port 45*d* and the toner replenishment port 44*a* The air in the developing device 4 is discharged from the communication port 45*d* through the gap. Accordingly, it is assumed that the pressure applied to the toner in the developer conveyance path 44 decreases, and the difficulty of toner movement is reduced. However, with the configurations illustrated in FIGS. 4 and 5, the difficulty of toner movement in the developer conveyance path 44 due to the air in the developing device being discharged from the communication port 45*d* is not sufficiently reduced.

Figure 6:
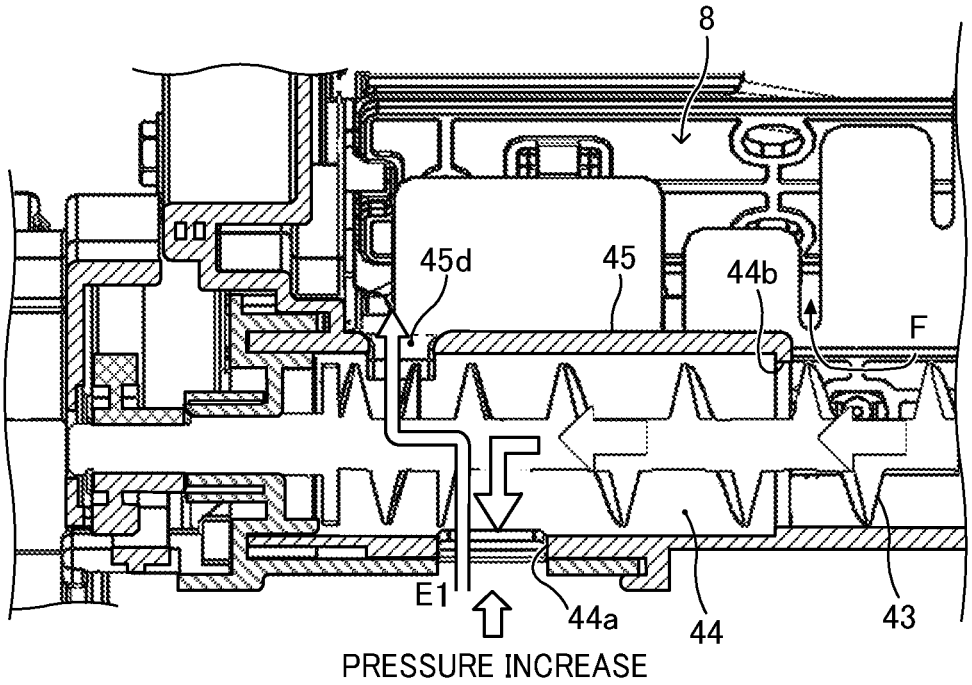
FIG. 6 is a cross-sectional view illustrating a decrease in an amount of toner replenishment when the toner in a developer chamber of the toner cartridge in FIG. 4 is low.

In the case in which the communication port 45*d* is disposed on the downstream side from the toner replenishment port 44*a* in the developer conveyance direction as illustrated in FIG. 4, the toner in the region downstream from the toner replenishment port 44*a* in the developer conveyance direction flows back through the communication port 45*d*, thereby forming the gap in the region downstream from the toner replenishment port 44*a* in the developer conveyance direction. As a result, the air in the developing device 4 flows as indicated by arrow E1 in FIG. 6. With such a gap, the toner can easily flow in the region downstream from the toner replenishment port 44*a* in the developer conveyance direction. Therefore, the configuration in FIG. 4 facilitates movement of the toner toward the toner replenishment port 44*a* in the region downstream from the toner replenishment port 44*a* in the developer conveyance direction.

However, only the toner that has not fallen through the toner replenishment port 44*a* moves to the region downstream from the toner replenishment port 44*a* in the developer conveyance direction. Further, the pitch of the second blade 43*a*2 disposed in the region downstream from the toner replenishment port 44*a* in the developer conveyance direction is narrower than the pitch of the first blade 43*a*1, and the amount of toner movement per rotation of the conveying screw 43 is low. Further, the direction of conveyance of toner in the region downstream from the toner replenishment port 44*a* in the developer conveyance direction is opposite to the direction of conveyance of toner between the toner supply port 44*b* and the toner replenishment port 44*a*. As a result, the difficulty of toner movement from the toner supply port 44*b* to the toner replenishment port 44*a* is not reduced so much, and a portion of the toner transported to the toner supply port 44*b* by the conveying screw 43 does not enter the developer conveyance path 44 from the toner supply port 44*b* but flows back to the developer chamber 8 as indicated by arrow F in FIG. 6. Therefore, in the case in which the communication port 45*d* is disposed on the downstream side from the toner replenishment port 44*a* in the developer conveyance direction, it is assumed that the decrease in the amount of toner supplied in a single replenishment is not sufficiently minimized.

Figure 7:
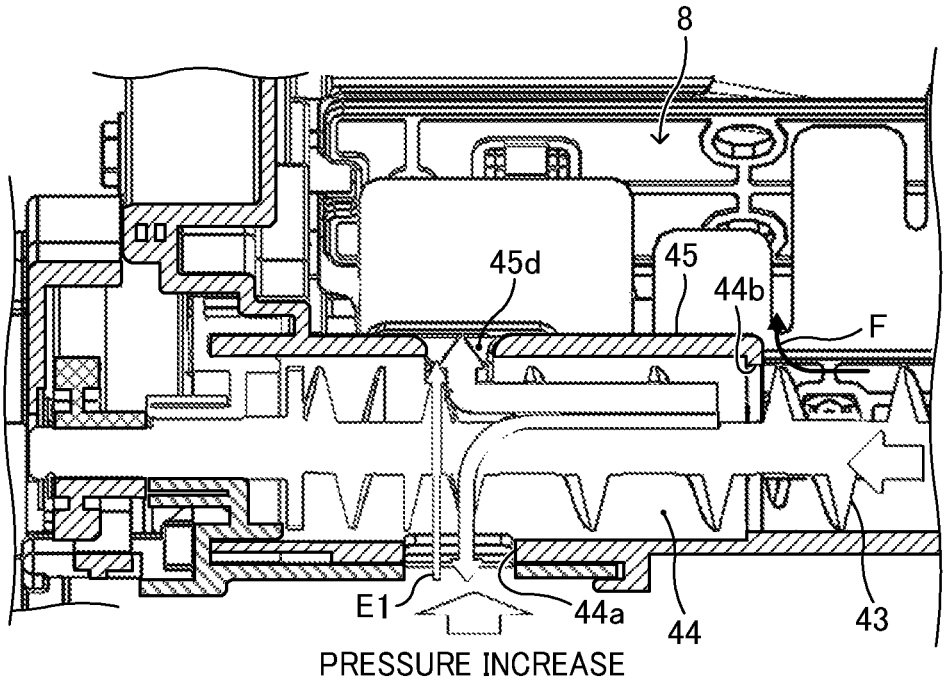
FIG. 7 is a cross-sectional view illustrating a decrease in an amount of toner replenishment when the toner in a developer chamber of the toner cartridge in FIG. 5 is low.

In the case in which the communication port 45*d* is disposed directly above the toner replenishment port 44*a* as illustrated in FIG. 5, the toner near the toner replenishment port 44*a* flows back to the communication port 45*d*, and the air in the developing device 4 flows as indicated by arrow E1 in FIG. 7. Since the toner near the toner replenishment port 44*a* flows back to the communication port 45*d*, the amount of toner near the toner replenishment port 44*a* decreases, causing toner to flow from the upstream side in the developer conveyance direction. As a result, the difficulty of toner movement upstream from the communication port 45*d* is gradually reduced. However, because the distance from the communication port 45*d* to the toner supply port 44*b* is long as illustrated in FIG. 5, it takes time to reduce the difficulty of toner movement in the entire region from the toner supply port 44*b* to the toner replenishment port 44*a*. As a result, it is assumed that it takes time from the start of replenishment until the difficulty of toner movement is reduced in the entire region from the toner supply port 44*b* to the toner replenishment port 44*a*, and the decreases in the amount of toner replenishment within one replenishment duration is not sufficiently reduced.

On the other hand, in the case according to the present embodiment in which the communication port 45*d* is disposed between the toner supply port 44*b* and the toner replenishment port 44*a*, the decrease in the amount of toner replenishment is reduced by about 20% when the amount of toner in the developer chamber 8 decreases. If the reduction is about 20%, a substantially predetermined amount of toner can be supplied even when the amount of toner in the developer chamber 8 is low.

Figure 8:
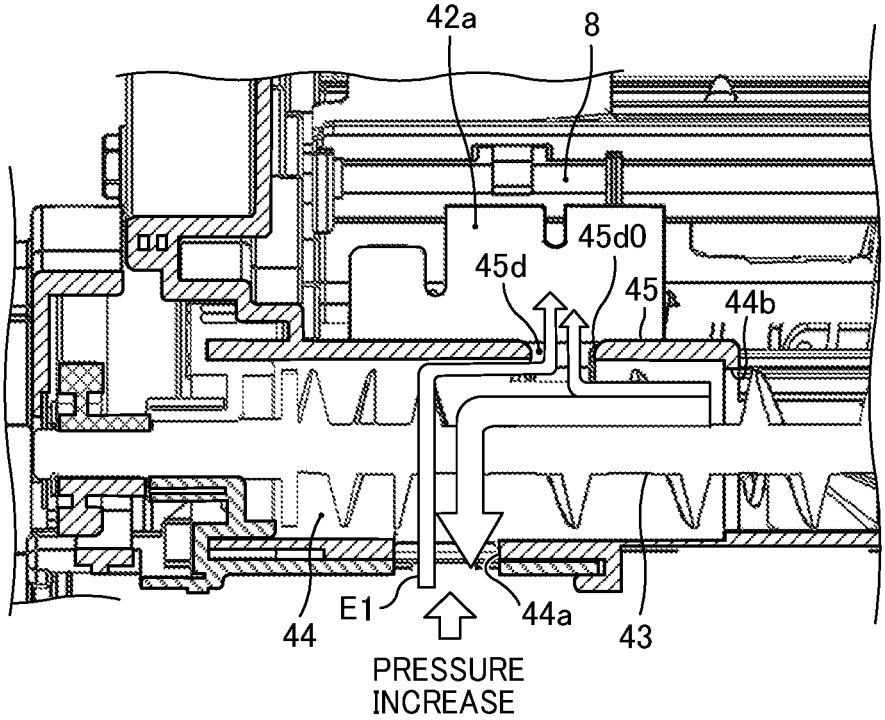
FIG. 8 is a cross-sectional view illustrating toner replenishment and an air flow from a developing device of the image forming apparatus when the toner in a developer chamber of the toner cartridge according to an embodiment of the present disclosure is low.

FIG. 8 is a cross-sectional view illustrating the toner replenishment and an air flow from the developing device 4 when the amount of toner in the developer chamber 8 decreases according to the present embodiment.

In the present embodiment, when the amount of toner in the developer chamber 8 is low, the toner in the developer conveyance path 44 flows back to the developer chamber 8 through the communication port 45*d* due to the internal pressure, a gap through which air in the developing device 4 flows is formed in the toner between the toner replenishment port 44*a* and the communication port 45*d*. As a result, the air in the developing device 4 flows as indicated by arrow E1 in FIG. 8. Since the gap through which the air in the developing device 4 flows is formed as described above, the toner easily moves between the toner replenishment port 44*a* and the communication port 45*d*, and the toner is favorably moved to the toner replenishment port 44*a* by the rotation of the conveying screw 43. In addition, the toner flows back through the communication port 45*d*, and the toner near the communication port 45*d* decreases, causing toner to flow from the upstream side. As a result, the difficulty of toner movement upstream from the communication port 45*d* is gradually reduced. In the present embodiment, the distance between the communication port 45*d* and the toner supply port 44*b* is shorter than the distance in the case in which the communication port 45*d* is disposed directly above the toner replenishment port 44*a*. Therefore, the difficulty of toner movement can be reduced in the entire region from the toner supply port 44*b* to the toner replenishment port 44*a* in a short time. As described above, it is assumed that since the difficulty of toner movement in the developer conveyance path is reduced in a relatively short time after the start of the toner replenishment, the decrease in the amount of toner replenishment per replenishment can be reduced.

Further, the downstream end of the communication port 45*d* is preferably located upstream from at least the upstream end of the toner replenishment port 44*a* in the developer conveyance direction. This is because, if the downstream end of the communication port 45*d* is located downstream from the upstream end of the toner replenishment port 44*a* in the developer conveyance direction and a part of the communication port 45*d* is located above the toner replenishment port 44*a*, the toner immediately before falling down through the toner replenishment port 44*a* may flow back through the communication port 45*d* to the developer chamber 8, causing the amount of toner replenishment to decrease. Accordingly, by positioning the downstream end of the communication port 45*d* upstream from at least the upstream end of the toner replenishment port 44*a* in the developer conveyance direction, the decrease in the amount of toner replenishment can be minimized.

Further, the upstream end of the communication port 45*d* is preferably located downstream from the toner supply port 44*b* in the developer conveyance direction and is preferably a hole surrounded by the closed rim 45*d*0 that is present in any direction perpendicular to the direction in which the developer conveyance path 44 communicates with the developer chamber 8 via the communication port 45*d*. This is because, if the upstream end of the communication port 45*d* is located at the position of the toner supply port 44*b* and the communication port 45*d* is connected to the toner supply port 44*b*, the amount of toner supplied to the developer conveyance path 44 is difficult to be controlled and the conveying screw 43 is not controlled to adjust the amount of toner replenishment satisfactorily.

In addition, if the communication port 45*d* is large, the amount of toner that flows back through the communication port 45*d* may increase and the amount of toner replenishment may decrease. Therefore, the communication port 45*d* is preferably not large so much.

Further, as illustrated in FIG. 3, a length L2 of the communication port 45*d* is preferably shorter (narrower) than a length L1 of the toner replenishment port 44*a* in the developer conveyance direction and the pitch P of the first blade 43*a*1 of the conveying screw 43. With this configuration, the amount of toner can be reduced that flows directly from the communication port 45*d* into the developer conveyance path 44 without passing through the toner supply port 44*b*. Thus, the amount of toner replenishment can be favorably controlled by the drive control of the conveying screw 43.

Further, the length L1 of the toner replenishment port 44*a* in the developer conveyance direction is shorter (narrower) than the pitch P of the first blade 43*a*1 of the conveying screw 43. The toner cartridge 7 includes a shutter that opens and closes the toner replenishment port 44*a*. As the toner cartridge 7 is installed in the printer 100, the shutter opens. Since the length L1 of the toner replenishment port 44*a* in the developer conveyance direction is shorter (narrower) than the pitch P of the first blade 43*a*1 of the conveying screw 43, the amount of toner that falls down through the toner replenishment port 44*a* can be minimized when the shutter opens.

Further, although the toner cartridge 7 according to the present embodiment includes the developer chamber 8 and the developer collection chamber 9, the developer collection chamber 9 may be separated from the toner cartridge 7.

As described above, according to the present disclosure, the decrease in an amount of developer discharged through a discharge port to a developing device when the amount of developer in a developer chamber is low can be minimized. The embodiments described above are examples and can provide, for example, the following effects, respectively.

Aspect 1

A developer container such as the toner cartridge 7 includes a developer chamber such as the developer chamber 8 to store a developer, a discharge port such as the toner replenishment port 44*a* to discharge the developer in the developer chamber 8 to the developing device 4, a developer conveyance path such as the developer conveyance path 44 to transport the developer in the developer chamber 8 to the discharge port, a supply port such as the toner supply port 44*b* to supply the developer in the developer chamber 8 to the developer conveyance path 44, a conveyor such as the conveying screw 43 disposed in the developer conveyance path 44 to transport the developer to the discharge port, a partition such as the partition 45 partitioning between the developer conveyance path 44 and the developer chamber 8, and a communication port such as the communication port 45*d* disposed in the partition 45 and between the discharge port and the supply port and connecting the developer conveyance path 44 with the developer chamber 8.

As described above, with this configuration of the communication port between the discharge port and the supply port, the decrease in the amount of developer discharged through the discharge port to the developing device 4 when the amount of developer in the developer chamber 8 is low can be effectively minimized.

Aspect 2

In aspect 1, the communication port 45*d* is a hole surrounded by a closed rim 45*d*0 in a direction perpendicular to a direction in which the developer conveyance path 44 communicates with the developer chamber 8 via the communication port 45*d*.

This configuration can prevent the developer from entering the developer conveyance path 44 through the communication port 45*d* and the amount of developer flowing back through the communication port 45*d* from increasing.

Aspect 3

In aspect 1 or 2, a length of the communication port 45*d* in the developer conveyance direction is shorter than a length of the discharge port such as the toner replenishment port 44*a* in the developer conveyance direction.

As described above in the above embodiments, this configuration can prevent the developer from entering the developer conveyance path 44 through the communication port 45*d* and the amount of developer flowing back through the communication port 45*d* from increasing.

Aspect 4

In any one of aspects 1 to 3, the conveyor such as the conveying screw 43 includes a shaft 43*b* and a helical blade such as the first blade 43*a*1 to transport the developer supplied to the supply port such as the toner supply port 44*b* to the discharge port such as the toner replenishment port 44*a*. A length of the communication port 45*d* in the direction of conveyance of the developer is shorter than one pitch of the helical blade.

As described above in the above embodiments, this configuration can prevent the developer from entering the developer conveyance path 44 through the communication port 45*d* and the amount of developer flowing back through the communication port 45*d* from increasing.

Aspect 5

In aspect 4, the one pitch of the helical blade such as the first blade 43*a*1 is longer than the length of the discharge port such as the toner replenishment port 44*a* in the direction of conveyance of the developer, and the length of the discharge port in the direction of conveyance of the developer is longer than the length of the communication port 45*d* in the direction of conveyance of the developer.

As described above in the above embodiments, this configuration can minimize the amount of toner that falls down through the discharge port such as the toner replenishment port 44*a* when the shutter opens, and prevent the developer from entering the developer conveyance path 44 through the communication port 45*d* and the amount of developer flowing back through the communication port 45*d* from increasing.

Aspect 6

A developer supply device includes a developer container such as the toner cartridge 7 in any one of aspects 1 to 5 to replenish the developer to the developing device 4.

As described in the above embodiment, this configuration can minimize the decrease in the amount of developer supplied to the developing device 4 when the amount of developer in the developer container is low.

Aspect 7

A process cartridge such as the process cartridge 1 includes an image bearer such as the photoconductor 2 to bear a latent image, the developing device 4 to develop the latent image on the image bearer, and the developer container such as the toner cartridge 7 in any one of aspects 1 to 5 to store the developer such as toner to be supplied to the developing device 4. The process cartridge 1 is removably installable in an image forming apparatus such as the printer 100.

This configuration can minimize the decrease in the amount of developer supplied to the developing device 4 when the amount of developer in the developer container is low.

Aspect 8

An image forming apparatus such as the printer 100 includes an image bearer such as the photoconductor 2 to bear a latent image, the developing device 4 to develop the latent image on the image bearer, and the developer container such as the toner cartridge 7 in any one of aspects 1 to 5 to store the developer such as toner to be supplied to the developing device 4.

This configuration can minimize the decrease in the amount of developer supplied to the developing device 4 when the amount of developer in the developer container is low.

The above-described embodiments are illustrative and do not limit the present disclosure. Thus, numerous additional modifications and variations are possible in light of the above teachings. For example, elements and/or features of different illustrative embodiments may be combined with each other and/or substituted for each other within the scope of the present disclosure.

What is claimed is:

1. A developer container comprising:

a developer chamber configured to store a developer;

a discharge port configured to discharge the developer in the developer chamber to a developing device;

a developer conveyance path configured to transport the developer to the discharge port;

a supply port configured to supply the developer in the developer chamber to the developer conveyance path;

a conveyor disposed in the developer conveyance path and configured to transport the developer to the discharge port;

a partition between the developer conveyance path and the developer chamber; and a communication port disposed in the partition between the discharge port and the supply port and connecting the developer conveyance path with the developer chamber.

2. The developer container according to claim 1, wherein the communication port is a hole surrounded by a closed rim being present in any direction perpendicular to a direction in which the developer conveyance path communicates with the developer chamber via the communication port.

3. The developer container according to claim 1, wherein a length of the communication port in a direction of conveyance of the developer is shorter than a length of the discharge port in the direction of conveyance of the developer.

4. The developer container according to claim 1, wherein the conveyor includes a shaft and a helical blade on the shaft, and is configured to transport the developer supplied to the supply port to the discharge port, and wherein a length of the communication port in a direction of conveyance of the developer is shorter than a pitch of the helical blade.

5. The developer container according to claim 4, wherein the pitch of the helical blade is longer than a length of the discharge port in the direction of conveyance of the developer, and wherein the length of the discharge port in the direction of conveyance of the developer is longer than the length of the communication port in the direction of conveyance of the developer.

6. A developer supply device comprising the developer container according to claim 1, wherein the developer supply device is configured to supply the developer to the developing device.

7. A process cartridge comprising:

an image bearer configured to bear a latent image;

the developing device configured to develop the latent image on the image bearer; and the developer container according to claim 1, configured to store the developer to be supplied to the developing device, wherein the process cartridge is configured to be removably installable in an image forming apparatus.

8. An image forming apparatus comprising:

an image bearer configured to bear a latent image;

the developing device configured to develop the latent image on the image bearer; and the developer container according to claim 1, configured to store the developer to be supplied to the developing device.

* * * * *